US006776955B1

(12) United States Patent
Lim et al.

(10) Patent No.: US 6,776,955 B1
(45) Date of Patent: Aug. 17, 2004

(54) NET SHAPED ARTICLES HAVING COMPLEX INTERNAL UNDERCUT FEATURES

(75) Inventors: Kay-Leong Lim, Singapore (SG); Lye-King Tan, Singapore (SG); Eng-Seng Tan, Singapore (SG)

(73) Assignee: Advanced Materials Technologies, Pte., Ltd., Singapore (SG)

( * ) Notice: Subject to any disclaimer, the term of this patent is extended or adjusted under 35 U.S.C. 154(b) by 0 days.

(21) Appl. No.: 09/655,113

(22) Filed: Sep. 5, 2000

(51) Int. Cl.[7] ..... B22F 3/00
(52) U.S. Cl. ..... 419/36
(58) Field of Search ..... 419/5, 36

(56) References Cited

U.S. PATENT DOCUMENTS

| | | | | | |
|---|---|---|---|---|---|
| 4,591,470 | A | * | 5/1986 | Goto et al. | 264/59 |
| 5,043,121 | A | * | 8/1991 | Wingefeld | |
| 5,332,543 | A | | 7/1994 | Zhang et al. | 419/36 |
| 5,397,531 | A | | 3/1995 | Peiris et al. | 419/36 |
| 5,401,462 | A | | 3/1995 | Zhang et al. | 419/37 |
| 5,415,830 | A | | 5/1995 | Zhang et al. | 419/36 |
| 5,666,633 | A | | 9/1997 | Arnold et al. | 419/10 |
| 5,950,063 | A | * | 9/1999 | Hens et al. | 419/5 |
| 5,972,269 | A | * | 10/1999 | Barros et al. | 264/221 |
| 5,980,820 | A | * | 11/1999 | Takeuchi | 419/37 |
| 6,194,894 | B1 | | 2/2001 | Apel et al. | 324/207.25 |
| 6,274,083 | B1 | * | 8/2001 | Clark, III | 419/5 |

FOREIGN PATENT DOCUMENTS

| | | | |
|---|---|---|---|
| WO | WO 93/17820 | 9/1993 | B22F/3/02 |

* cited by examiner

*Primary Examiner*—Ngoclan T. Mai
(74) *Attorney, Agent, or Firm*—George O Saile; Stephen B. Ackerman

(57) ABSTRACT

This invention describes a novel production method of manufacturing metal/ceramic articles with complex internal undercut features using powder injection molding processes The shape of the undercut/hollow feature is initially molded using a disposable material such as a degradable polymer. The PIM feedstock is then molded onto this to form the required shape geometry, in effect encapsulating the polymeric feature in the PIM feedstock. The resulting two-material part is then sent for processing which removes the polymer through solvent or thermal process. After the polymer and the binder have been removed, the part now comprises a powder skeleton that contains the internal undercut feature within itself. After sintering the result is a metal/ceramic part having an internal undercut feature. The technical advantage of the present invention is that it does not require complex toolings or costly secondary operations while retaining the flexibility to design any internal undercut features of complex geometry. An additional embodiment of the invention is also disclosed in which a solid structure is encapsulated inside a hollow shell said structure being free to move around inside the shell.

15 Claims, 4 Drawing Sheets

NET SHAPED ARTICLES HAVING COMPLEX INTERNAL UNDERCUT FEATURES

FIELD OF THE INVENTION

The invention relates to the general field of powder injection molding (PIM) with particular reference to ways to manufacture structures having complex shapes.

BACKGROUND OF THE INVENTION

The traditional methods of molding parts, for example plastic or composite parts, by vacuum molding, sheet compound molding, reaction injection molding, injection molding and/or rotational molding require expensive, complex and specific tooling in order to form a particular molded part shape. If a designer chooses to include features such as undercuts in the molded part, expensive, complicated collapsible tooling is required to remove the tool from the molded part in the area of the undercut. Such expensive, complicated tooling generally must include a complex system of slides and ways to remove the tooling from the formed part. Even if the undercut is permitted at molding, the shape and complexity are very much limited.

Some undercut or internal features can also be molded by introducing gas under pressure, as in blow injection molding. While this does not require complex tooling, again the shape and complexity of undercut or internal feature is limited to simple geometries The new technology of powder injection molding, can likewise require expensive tooling, depending on the complexity of the part and the number of cavities. To include undercut features in the molded part requires complicated tooling with slides and ways.

Even if such methods are to be employed, the complexity of the undercut is very limited. Manufacturers have to purchase or construct very complex tooling in order to form simple undercuts in their molded parts. Otherwise they simply have to forego such undercuts and process the molded parts into the sintered parts. This means that expensive secondary operations must be added to the process to introduce the undercut features into the sintered parts. Again, there is a limit to the complexity of the undercuts and, most often, such operations are time-consuming and have low production output.

A routine search of the prior art was performed. The following references of interest were found. All are concerned with methods to form or remove binders and feedstock:

Zhang et al. U.S. Pat. No. 5,332,543, "Method for producing articles from particulate materials using a binder derived from an idealized TGA curve"; Zhang et al. U.S. Pat. No. 5,415,830, "Binder for producing articles from particulate materials"; Peiris et al. U.S. Pat. No. 5,397,531 "Injection-moldable metal feedstock and method of forming metal injection-molded article"; and Zhang et al. U.S. Pat. No. 5,401,462 "Removal of binder for producing articles from particulate materials by use of a specific TGA curve".

SUMMARY OF THE INVENTION

It has been an object of the present invention to provide a process for manufacturing a metal/ceramic article, including undercut or hollow features, which does not require the use of expensive and complicated tooling Another object of the present invention has been to provide a process for manufacturing complex internal undercut features without the use of costly secondary operations on the sintered parts.

A further object has been that said process be well suited to mass production and be economical to use.

These objects have been achieved by the disclosure of a process in which the shape of the undercut/hollow feature is initially molded using a disposable material such as a degradable polymer. The PIM feedstock is then molded onto this to form the required shape geometry, in effect encapsulating the polymeric feature by the PIM feedstock. The resulting two-material part is then sent for processing which removes the polymer through solvent or thermal process. The binder inside the PIM feedstock is then also removed through either solvent or thermal processes. After the polymer and the binder have been removed, the part now comprises a powder skeleton that contains the internal undercut feature within itself After sintering the result is a metal/ceramic part with internal undercut feature. The technical advantage of the present invention is that it does not require complex toolings or costly secondary operations while retaining the flexibility to design any internal undercut features of complex geometry. An additional embodiment of the invention is also disclosed in which a solid structure is encapsulated inside a hollow shell said structure being free to move around inside the shell.

DESCRIPTION OF THE PREFERRED EMBODIMENTS

Figure 1:
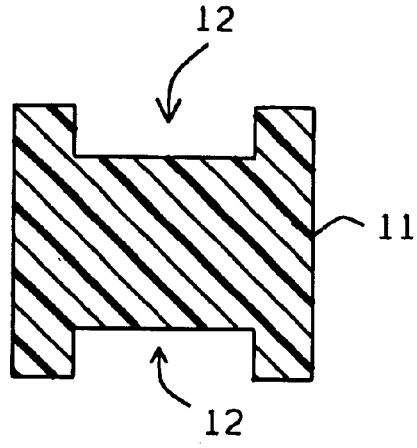
FIG. 1 illustrates how the shape of the undercut/hollow feature is first molded using a disposable material such as a degradable polymer.

Although the present invention is of a general nature, being applicable to any moldable materials, we will describe it in terms of the material of primary interest which is a metal/ceramic powder mixed with a plasticizer (also known as a binder) to form a feedstock which can be injection molded using conventional injection molding machines. Organic polymeric binders are typically included in the molded articles for the purpose of holding them together, being unbinded prior to sintering. Essentially any organic material which will function as a binder and which will decompose under elevated temperatures (without leaving an undesirable residue that will be detrimental to the properties of the metal articles) can be used in the present invention. Preferred materials are various organic polymers such as stearic acids, micropulvar wax, paraffin wax and polyethylene.

To produce an internal undercut feature in the finished articles, a disposable material, typically but not necessarily, a polymer such as polyethylene, polystrylene and polyproylene is injected to form the required shape and design. The dimensions of the polymeric undercut shape are determined by the size of the tooling used, which in turn is determined by the dimensions of the desired finished articles, taking into account the shrinkage of the articles during the sintering process.

This molded polymer part is placed in the cavity of the tooling that forms the actual article. The PIM feedstock is injection molded onto the disposable part that forms the overall shape of the article. For example, the metal feedstock can be injection molded using conventional single barrel injection molding machines to form green articles. It can also be injected using a two-barrel injection molding machine where one barrel consists of PIM feedstock material while another consists of polymer material so that the complete green articles with the polymeric internal feature can be molded in a single two-barrel injection machine to increase productivity.

The tooling for powder injection molding is similar to that of traditional plastic injection plastic or polymer injection molding. A major difference is that PIM tooling is designed to be oversized to allow for sintering shrinkage. The shape of the internal undercut feature can be molded from any suitable disposable material, typically a plastic/polymer, which may be either thermoplastic or thermosetting. Preferred thermoplastic compounds that may be used for PIM binders include polyethylene, polypropylene, polystyrene etc. Even more preferably, some portion of wax, gel, agar, or glycol to be mixed with the plastic. The compound for the internal undercut feature must provide sufficient rigidity while still being easy to remove through solvent or thermal processes. The former includes both liquid and gaseous etchants, chosen as appropriate for the removal of the selected disposable material, while the latter include melting, vaporization, and ash-free combustion.

After the feedstock has been injection molded into the desired shape, that may have a complex geometry, the binder and disposable internal feature are removed by any one of a number of well known debinding techniques available to the powder injection molding industry such as, but not limited to, solvent extraction, thermal, catalytic or wicking. Then, the molded or formed article from which the binder and the plastic have been removed, is densified in a sintering step in any one of a number of furnace types such as, but not limited to, batch vacuum, continuous atmosphere or batch atmosphere. Most preferably, the sintering process is carried out in batch vacuum furnace as this is efficient, flexible, and economical.

The selection of supporting plates used for sintering process is important. It is desirable that alumina or other materials which do not decompose or react under sintering conditions be used as a supporting plate for the articles in the furnace. Contamination of the articles whose material is metal alloys can occur if suitable plates are not used. For example, pure graphite is not suitable as it reacts with ferrous material.

The physical dimensions and weight of sintered metal alloys are consistent from batch to batch. The variability of dimensions and weights within the same batch is minimal. Close tolerances of dimensions and weight can be achieved and thus eliminate the need for secondary machining processes which can be costly and difficult. After the sintering process is finished, articles having the undercut features made possible by the present invention may be removed from the sintering furnace and used as is. Alternatively, they may be subjected to well-known conventional secondary operations such as a glass beading process to clean the sintered surface and tumbling to smooth off sharp edges and remove burrs.

First Embodiment

The process of the present invention begins with the provision of a mixture of metal and ceramic powders, lubricants, and binders, to form a feedstock. Referring now to FIG. 1, we show there, in a schematic representation, molded part 11 made of a material which can be readily disposed of at a later stage, typically a polymer mixed with wax, gel, agar, or glycol, as discussed above. Note that the shape of 11 is such that it includes two concavities 12.

Figure 2:
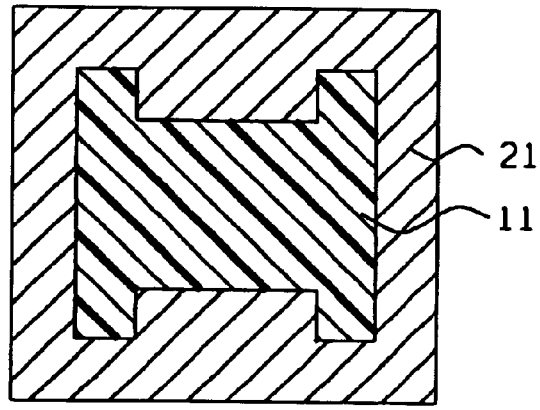
FIG. 2 shows the molded article of FIG. 1 encapsulated within the feedstock.
Figure 3:
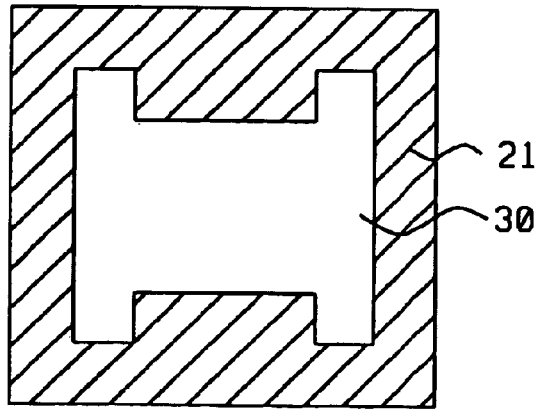
FIG. 3 illustrates the end product—a fully sintered cermet structure having an undercut/hollow shape.

Next, through powder injection molding of the feedstock, a second molded part 21 is formed around 11 whose outer surface it contacts. This is shown in FIG. 2. Then, the first molded part 11 is disposed of, using any of the several methods discussed earlier. Note that, in practice, blow holes would be needed for a fully enclosed structure such as this. Adding these is a matter of routine for those skilled in the art so they have not been explicitly shown. The net result is the structure illustrated in FIG. 3 which can be seen to consist of an outer shell 21 enclosing a hollow area 30.

The process concludes with a suitable heat treatment (details of which are given below) to enable the particles that make up the feedstock to fuse together through sintering.

Second Embodiment

Figure 4:
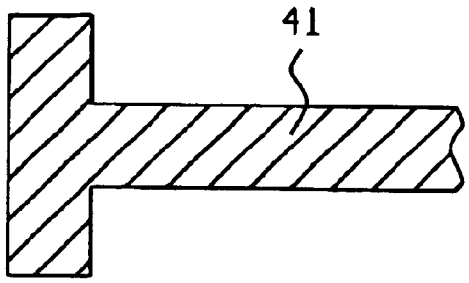
FIGS. 4–6 illustrate steps in the formation of a hollow cermet shell within which lies a structure that is free to move.

As in the first embodiment, the process of the second embodiment begins with the provision of a mixture of metal and ceramic powders, lubricants, and binders, to form a feedstock. Additionally, a solid structure such as piston 41, as illustrated in FIG. 4, is provided. We use the piston shape only as an example, the structure's shape, per se, having no bearing on the invention.

Figure 5:
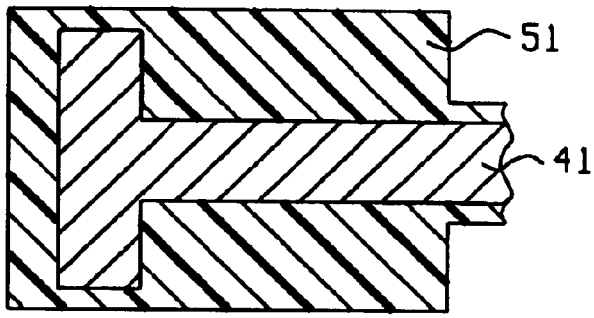
Figure 6:
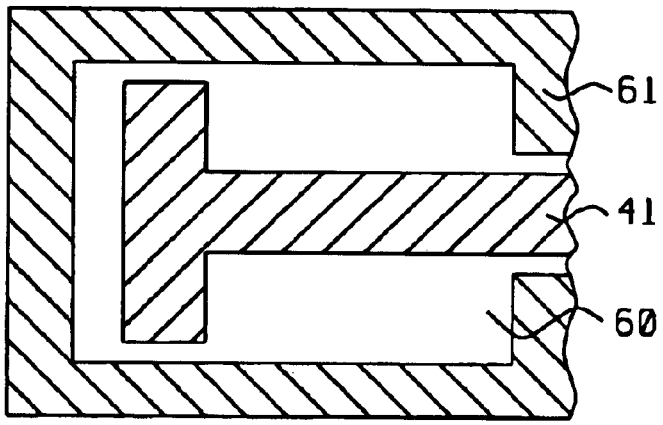

Then, using a disposable material of the type discussed earlier, first molded part 51 is formed. It contacts and fully surrounds structure 41 as seen in FIG. 5. This is followed by the formation of second molded part 61, through powder injection molding of the feedstock, part 61 being in contact with first molded part 51 which is then disposed of using any of the methods discussed above, resulting in the structure illustrated in FIG. 6.

As with the first embodiment, the process concludes with a suitable heat treatment to enable the particles that make up the feedstock to fuse together through sintering. In this way hollow casing 61 is formed, leaving structure 41 free to move inside it. We also note here that structure 41 could be formed from a magnetic material so that its movement could be controlled by external means.

Applications

Articles with internal undercut features produced in the present invention can be used in a variety of different industrial applications, especially parts with internal fluid flow passages for cooling in the same way as the prior art. Such articles are readily produced in quantity, economically and with short turnover time. They do not require costly post secondary operations to produce the internal undercut features. The sintered metal and cermet parts featured in the present invention are of high density and can be easily and rapidly produced in large quantities as articles of intricate shape and profile. Variability in weight and physical dimension between successful parts is very small. The tolerance of the undercut dimensions can achieve 0.5% of the linear dimension which means that post sintering machining and other mechanical working can be totally eliminated.

EXAMPLES

A 20 kg batch of feedstock was prepared. It contained 58% by volume of 17-4 PH stainless steel powder (of average particle size 10–15 microns) and 42% binder. The latter was (by weight) 5% stearic acid, 25% micropulvar wax, 20% semi-refined paraffin wax, and 50% polyethylene alathon.

Figure 7:
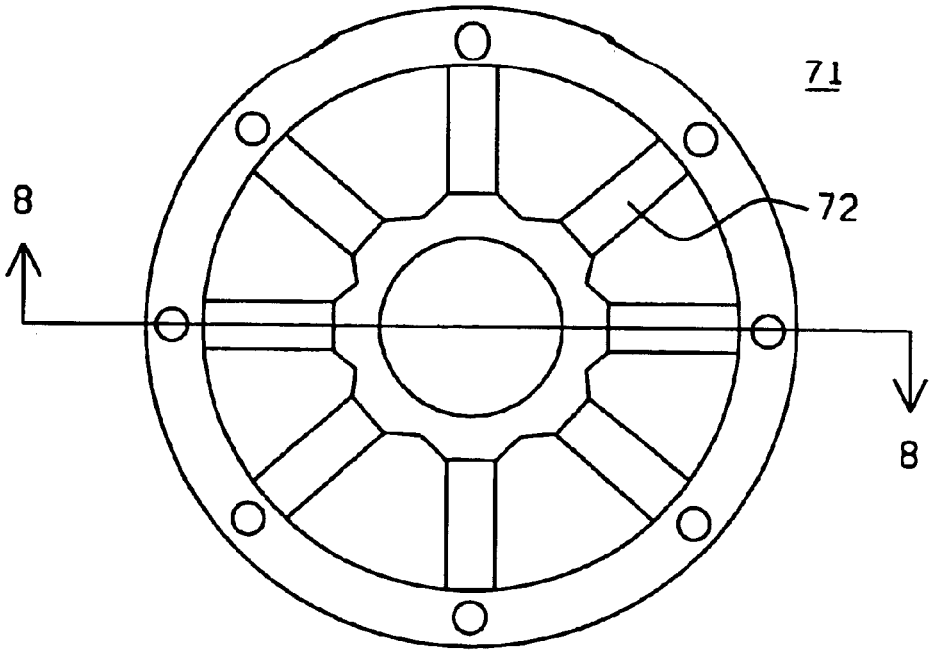
FIG. 7 shows a plan view of a wheel-like structure molded using a degradable polymer.
Figure 8:
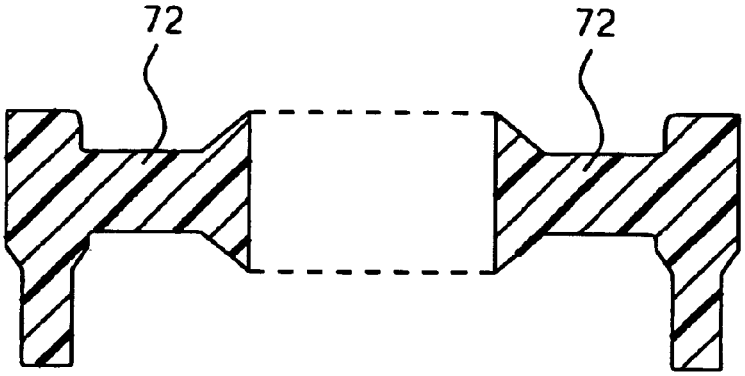
FIG. 8 is a cross-section through one of the spokes of FIG. 7.
Figure 9:
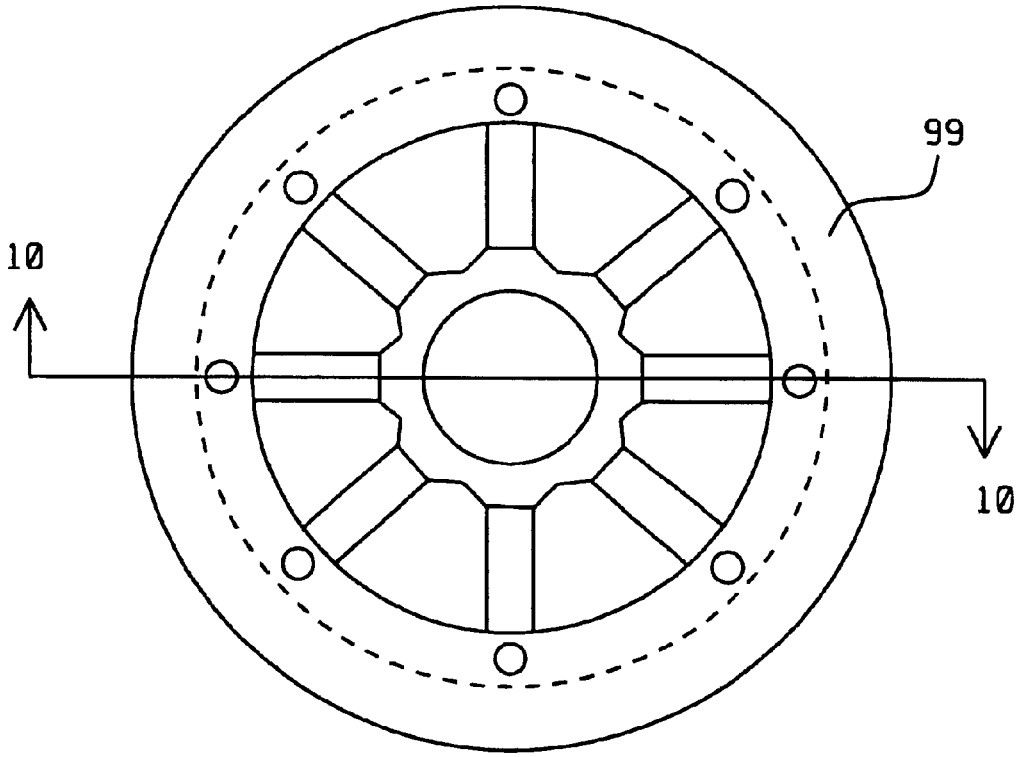
FIG. 9 shows the result of molding cermet feedstock over the structure of FIG. 7 and then disposing of the latter.
Figure 10:
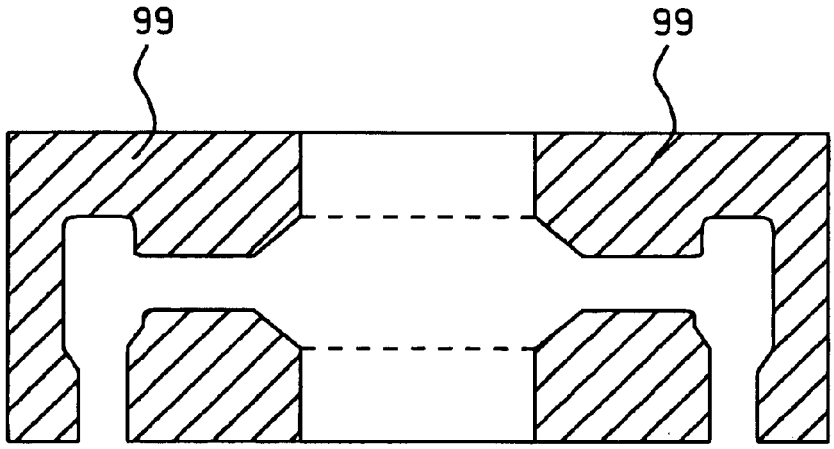
FIG. 10 is a cross-section through one of the spokes (now hollow tubes) of FIG. 7.

Referring, now to FIG. 7, an injection-molding machine was fitted with a mold for an internal undercut feature. This was a round feature having a cart wheel shape 71, including spokes 72. It was injected molded with polyethylene containing 20% paraffin wax. Cross-section 8—8 of 71 is shown in FIG. 8. The polyethylene feature 71 was then transferred to another mold where the 17-4 PH feedstock was injected onto the polymeric feature to form round disc 99 as shown in FIG. 9. The sintered disc had a total diameter of 19.0 mm and a height 7.5 mm. Based on the expected linear sintering shrinkage of 13%, the mold was 13% larger than the disc in all dimensions, so the polymeric feature was also 13% larger. The injection-molding composition was melted at a composition temperature of 190° C. and injected into the mold which was at 100° C. After a cooling time of about 20 seconds, the green parts were taken from the mold.

The green parts containing the metal powder were freed of all organic binder by heating in the controlled furnace over a period of 25 hours at 600° C. in a nitrogen atmosphere. This heat treatment also served to remove polymeric disc 71 from the green part, leaving behind a cart wheel shaped hollow feature inside the green part. The green round disc containing the binder-free metal powder was then laid on an alumina oxide supporting plate and was heated to 1,350° C. attained at a rate of 350° C./hr under a vacuum of less than 0.01 torr in a high temperature sintering furnace. The sintering time was 60 minutes at 1,350° C., following which the sintering furnace was allowed to cool. This resulted in a round disc with an internal hollow cart wheel feature, having exactly the correct dimensions. The density of the sintered part was measured at 7.62 g/cm$^3$ which is close to theoretical density.

While the invention has been particularly shown and described with reference to the preferred embodiments thereof, it will be understood by those skilled in the art that various changes in form and details may be made without departing from the spirit and scope of the invention.

What is claimed is:

1. A process for forming a hollow article, comprising:

providing a mixture of metal and ceramic powders, lubricants, and binders, that form a feedstock;

using a disposable material, forming a first molded part that has an outer surface;

through powder injection molding of the feedstock, forming a second molded part that is in contact with said outer surface;

disposing of the first molded part through ash-free combustion; and heating the second molded part whereby sintering occurs and said hollow article is formed.

2. The process of claim 1 wherein said disposable material is selected from the group consisting of thermoplastic polymers, thermosetting polymers, thermoplastic polymers mixed with wax, thermosetting polymers mixed with wax, thermoplastic polymers mixed with gel, thermosetting polymers mixed with gel, thermoplastic polymers mixed with agar, thermosetting polymers mixed with agar, thermoplastic polymers mixed with glycol, and thermosetting polymers mixed with glycol.

3. The process of claim 1 wherein the step of sintering is performed in a vacuum furnace or in an atmospheric furnace.

4. A process for forming a hollow article, comprising;

providing a mixture of metal and ceramic powders, lubricants, and binders, that form a feedstock;

providing tooling that is able to injection mold from a first barrel into a first mold and from a second barrel into a second mold;

using a disposable material, injected from the first barrel into the first mold, forming a first molded part that has an outer surface;

through powder injection molding of the feedstock from the second barrel into the second mold, forming a second molded part that is in contact with said outer surface;

disposing of the first molded part through ash-free combustion; and heating the second molded part whereby sintering occurs and said hollow article is formed.

5. The process of claim 4 wherein said disposable material is selected from the group consisting of thermoplastic polymers, thermosetting polymers, thermoplastic polymers mixed with wax, thermosetting polymers mixed with wax, thermoplastic polymers mixed with gel, thermosetting polymers mixed with gel, thermoplastic polymers mixed with agar, thermosetting polymers mixed with agar, thermoplastic polymers mixed with glycol, and thermosetting polymers mixed with glycol.

6. The process of claim 4 wherein the step of sintering is performed in a vacuum furnace or in an atmospheric furnace.

7. A process for forming a hollow article, comprising;

providing a mixture of metal and ceramic powders, lubricants, and binders, that form a feedstock;

providing first and second tooling, one being able to injection mold from a first barrel into a first mold and one being able to injection mold from a second barrel into a second mold;

in the first tooling, using a material, injected from the first barrel into the first mold, forming a first molded part that has an outer surface;

transferring the first molded part to the second tooling;

in the second tooling, through powder injection molding of the feedstock from the second barrel into the second mold, forming a second molded part that is in contact with said outer surface;

disposing of the first molded part through ash-free combustion; and heating the second molded part whereby sintering occurs and said hollow article is formed.

8. The process of claim 7 wherein said material is selected from the group consisting of thermoplastic polymers, thermosetting polymers, thermoplastic polymers mixed with wax, thermosetting polymers mixed with wax, thermoplastic polymers mixed with gel, thermosetting polymers mixed with gel, thermoplastic polymers mixed with agar, thermosetting polymers mixed with agar, thermoplastic polymers mixed with glycol, and thermosetting polymers mixed with glycol.

9. The process of claim 7 wherein the step of sintering is performed in a vacuum furnace or in an atmospheric furnace.

10. A process for forming a hollow casing with an internal moving part, comprising;

providing a structure, said structure having a first outer surface;

providing a mixture of metal and ceramic powders, lubricants, and binders, that form a feedstock;

using a disposable material, forming a first molded part that contacts, and fully surrounds, said first outer surface, said first molded part having a second outer surface;

through powder injection molding of the feedstock, forming a second molded part that contacts said second outer surface;

disposing of the first molded part; and heating the second molded part whereby cermet formation through sintering occurs, said hollow casing is formed, and the structure is free to move inside said casing.

11. The process of claim 10 wherein said disposable material is selected from the group consisting of thermoplastic polymers, thermosetting polymers, thermoplastic polymers mixed with wax, thermosetting polymers mixed with wax, thermoplastic polymers mixed with gel, thermosetting polymers mixed with gel, thermoplastic polymers mixed with agar, thermosetting polymers mixed with agar, thermoplastic polymers mixed with glycol, and thermosetting polymers mixed with glycol.

12. The process of claim 10 wherein said disposable material is disposed of through melting or vaporization or ash-free combustion.

13. The process of claim 10 wherein said disposable material is disposed of through attack by a solvent.

14. The process of claim 10 wherein the step of cermet formation through sintering is performed in a vacuum furnace or in an atmospheric furnace.

15. The process of claim 10 wherein the structure is magnetic.

* * * * *